US005583095A

United States Patent [19]

Kobayashi et al.

[11] Patent Number: 5,583,095

[45] Date of Patent: Dec. 10, 1996

[54] LIQUID COMPOSITIONS

[75] Inventors: Hideki Kobayashi; Toru Masatomi, both of Chiba Prefecture, Japan

[73] Assignee: Dow Corning Toray Silicone Co., Ltd., Tokyo, Japan

[21] Appl. No.: 544,047

[22] Filed: Oct. 17, 1995

[30] Foreign Application Priority Data

Oct. 28, 1994 [JP] Japan ..... 6-288928

[51] Int. Cl.$^6$ ..... C10M 155/02

[52] U.S. Cl. ..... 508/207

[58] Field of Search ..... 252/49.6, 58, 174.15; 44/320; C10M 107/50, 155/02

[56] References Cited

U.S. PATENT DOCUMENTS

| | | | |
|---|---|---|---|
| 3,336,352 | 8/1967 | Omietanski | 252/49.6 |
| 4,938,881 | 7/1990 | Ripple et al. | 252/32.7 E |
| 4,946,611 | 8/1990 | Kaneko | 252/49.6 |
| 5,442,083 | 8/1995 | Kobayashi | 556/434 |

FOREIGN PATENT DOCUMENTS

| | | |
|---|---|---|
| 124193 | 6/1987 | Japan . |
| 95193 | 4/1989 | Japan . |

*Primary Examiner*—Prince Willis, Jr.
*Assistant Examiner*—Cephia D. Toomer
*Attorney, Agent, or Firm*—Alexander Weitz

[57] ABSTRACT

There is disclosed a liquid composition which does not readily phase separate, has a low surface tension, and exhibits excellent lubricating properties, said composition comprising (A) 100 parts by weight of a hydrocarbon oil that is liquid at ordinary temperature; and (B) 0.01 to 500 parts by weight of an organosilicon polymer that is liquid at ordinary temperatures, said polymer having the general formula $$R^2-\underset{\substack{|\\R^1}}{\overset{\substack{R^1\\|}}{Si}}O(\underset{\substack{|\\R^1}}{\overset{\substack{R^1\\|}}{Si}}-R^3-\underset{\substack{|\\R^1}}{\overset{\substack{R^1\\|}}{Si}}O)_m(\underset{\substack{|\\R^1}}{\overset{\substack{R^1\\|}}{Si}}O)_n-\underset{\substack{|\\R^1}}{\overset{\substack{R^1\\|}}{Si}}R^2$$

wherein $R^1$ denotes an non-alkenyl monovalent hydrocarbon radical, $R^2$ is a radical selected from the group consisting of monovalent hydrocarbon radicals, hydrogen and hydroxyl, $R^3$ is an alkylene radical, m is an integer with a value of at least 2, n is an integer with a value of zero or greater and $m \geqq n$.

18 Claims, No Drawings

LIQUID COMPOSITIONS

FIELD OF THE INVENTION

This invention relates to liquid compositions and, more particularly, to liquid compositions comprising mixtures of a hydrocarbon oil and an organosilicon polymer.

BACKGROUND OF THE INVENTION

Hydrocarbon oils are widely used as base oils for cosmetic raw materials, fiber lubricants, food additives, mechanical lubricating oils, release agents, defoamers, inter alia. Hydrocarbon oils are characterized by low cost and excellent resistance to acid and alkali. On the other hand, the dimethylpolysiloxane oils, which are used in the very same applications as the hydrocarbon oils, are characterized by low surface tension and excellent resistance to heat and cold. However, the dimethylpolysiloxane oils are expensive, and this has limited their use to a narrower range of applications.

Investigations have been made into base oils prepared by blending dimethylpolysiloxane oil into a hydrocarbon oil. However, these two components are inherently incompatible and separate from each other as time elapses after their mixing.

Numerous methods have already been proposed in order to solve this problem. Thus, for example, Japanese Patent Application Laid Open Number Sho 62-124193 teaches the blending of alkyl-modified polysiloxane oil into mineral oil as a method for preparing a lubricating oil suitable for application as a refrigerant. Japanese Patent Application Laid Open Numbers Hei 1-153792 and Hei 1-95193 teach the blending of fluoroalkyl-functional polysiloxane oil into mineral oil as a method for preparing a lubricating oil suitable for reducing the friction at the rubbing zones of plastic substrates.

There are, however, limitations on the use of the former lubricating oil—which contains alkyl-modified polysiloxane oil—because it does not invariably give a good lubricating performance. The latter lubricating oils—which contain fluoroalkyl-modified polysiloxane—suffer from a poor lubricating performance and an expensive polysiloxane component.

SUMMARY OF THE INVENTION

It has now been discovered that a special organosilicon polymer containing the silalkylenesiloxane unit is very compatible with hydrocarbon oils and induces a substantial reduction in their surface tension.

In specific terms, the present invention takes as its object the introduction of a highly storage-stable liquid composition that exhibits a low surface tension and an excellent lubricating performance, said composition (A) 100 weight parts of a hydrocarbon oil that is liquid at ordinary temperatures and (B) 0.01 to 500 weight parts of a organosilicon polymer with the following general formula that is liquid at ordinary temperatures

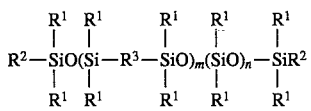

wherein $R^1$ denotes non-alkenyl monovalent hydrocarbon radicals; $R^2$ is a radical selected from monovalent hydrocarbon radicals, hydrogen, or hydroxyl radical; $R^3$ is an alkylene radical; m is an integer having a value of at least 2; n is an integer with a value of zero or greater; and m is greater than or equal to n.

The present invention has been disclosed in Japanese Laid Open Patent Application Number Hei 6-288928, the full disclosure of which is hereby incorporated by reference.

DETAILED DESCRIPTION OF THE INVENTION

Component (A) of the present invention is a hydrocarbon oil that is liquid at ordinary temperatures and is the base ingredient of the instant composition. For the purpose of the present invention, the term "ordinary temperatures" is used to indicate that the oil is a liquid at about 25° C. This component encompasses petroleum derivatives comprising mixtures of paraffinic hydrocarbons, naphthenic hydrocarbons, and the like, and mineral oils, liquid paraffins, and the like. This component is exemplified by the distilled oils afforded by ambient-pressure or reduced-pressure distillation and by the refined oils, solvent-refined oils, hydrogenatively refined oils, dewaxed oils, clay-treated oils, etc., that are obtained by refining said distilled oils. Among these, the highly branched hydrocarbon oils, which are nonvolatile fluids, are particularly useful. Synthetic oils encompassed herein in addition to the preceding are exemplified by alkylbenzenes, alkyldiphenyls, polyolefin synthetic oils such as poly(alpha-olefin)s, condensed synthetic oils from chloroparaffins and aromatic cyclics.

No specific restrictions attach to the viscosity of component (A) as long as it is a liquid at ordinary temperatures. However, viewed from the perspective of facilitating preparation of the composition according to the present invention, viscosities at 25° C. in the range from 5 to 50,000 centistokes (cS) are preferred and viscosities at 25° C. in the range from 10 to 10,000 centistokes are particularly preferred.

The organosilicon polymer constituting the component (B) is the component that characterizes the present invention. This component functions to equip the composition according to the present invention with a low surface tension and excellent lubricating properties. Organosilicon polymer (B) has the following general formula.

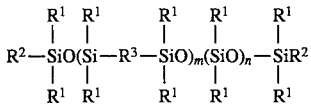

In the above formula, $R^1$ denotes a monovalent hydrocarbon radical, with the exception of alkenyl radical, and $R^1$ is specifically but nonexhaustively exemplified by alkyl radicals such as methyl, ethyl, propyl, butyl, and so forth; aryl radicals such as phenyl, tolyl, xylyl, and so forth; aralkyl radicals such as benzyl, phenethyl, and so forth; and halogen-substituted alkyl radicals such as chloropropyl, 3,3,3-trifluoropropyl, 3,3,4,4,5,5,6,6,6-nonafluorohexyl, heptadecafluorodecyl, and so forth. Methyl and phenyl are preferred for $R^1$. The $R^1$ radicals within a single molecule may all be the same or may differ. $R^2$ in the preceding formula is a radical selected from the group consisting of monovalent hydrocarbon radicals, hydroxyl radical, and hydrogen, wherein said monovalent hydrocarbon radicals are exemplified by alkyl radicals such as methyl, ethyl, propyl, butyl, and so forth; alkenyl radicals such as vinyl, allyl, butenyl, pentenyl, hexenyl, and so forth; aryl radicals such as phenyl, tolyl, xylyl, and so forth; and aralkyl radicals such as benzyl, phenethyl, and so forth. $R^3$ in the preceding formula is an alkylene radical, as specifically exemplified by ethylene, propylene, butylene, and hexylene. The subscript m in the preceding formula, which indicates the degree of polymerization of the silalkylenesiloxane unit, is an integer with a value of at least 2. The subscript n, which indicates the degree of polymerization of the diorganosiloxane unit, is an integer with a value of zero or greater. Finally, m is preferably equal to or greater than n.

No specific restrictions attach to the viscosity of component (B) as long as it is a liquid at ordinary temperatures. However, viewed from the perspective of facilitating preparation of the composition according to the present invention, viscosities at 25° C. in the range from 5 to 50,000 centistokes are preferred and viscosities at 25° C. in the range from 10 to 10,000 centistokes are particularly preferred. Subject component (B) is specifically exemplified by organosilicon polymers with the following formulas, in which m and n retain their definitions from above.

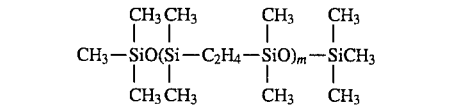

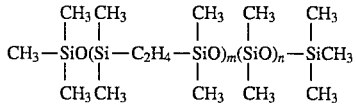

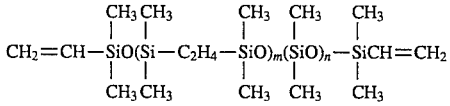

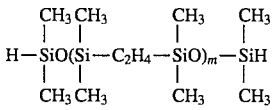

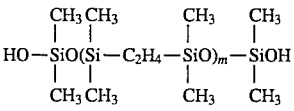

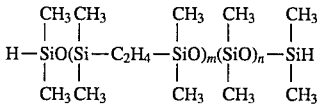

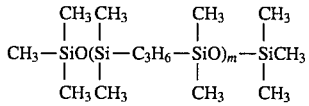

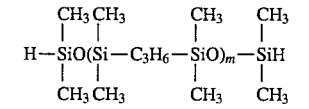

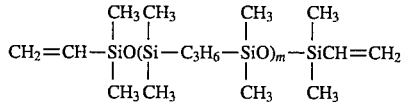

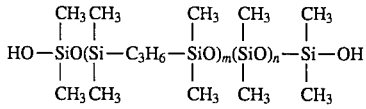

-continued

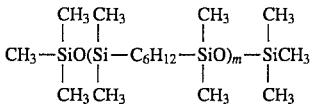

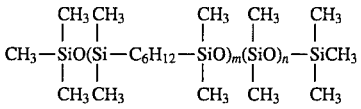

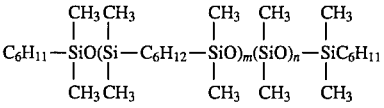

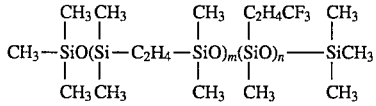

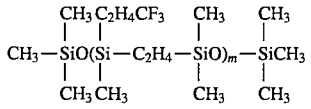

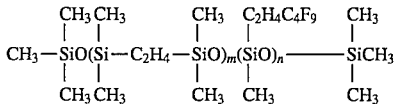

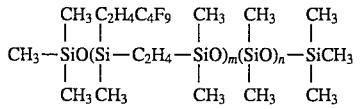

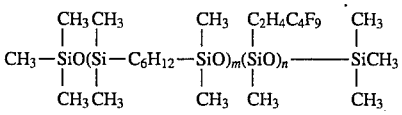

The method for preparing component (B) is not critical. The following methods are provided as examples of the synthesis of this component:

(i) the platinum-catalyzed addition reaction between 1,3-dihydrogendisiloxane and 1,3-dialkenyldisiloxane, wherein said 1,3-dihydrogendisiloxane is exemplified by 1,1,3,3-tetramethyldisiloxane, 1,3-dimethyl-1,3-diphenyldisiloxane, and so forth, and said 1,3-dialkenyldisiloxane is exemplified by 1,1,3,3-tetramethyl-1,3-divinyldisiloxane, 1,1,3,3-tetramethyl-1,3-diallyldisiloxane, 1,3-dimethyl-1,3-diphenyl-1,3-divinyldisiloxane, and so forth;

(ii) the platinum-catalyzed addition reaction between SiH-terminated polysilalkylenesiloxane and vinyl-terminated dimethylpolysiloxane;

(iii) the platinum-catalyzed addition reaction between vinyl-terminated polysilalkylenesiloxane and SiH-terminated dimethylpolysiloxane;

(iv) the condensation reaction between silanol-terminated polysilalkylenesiloxane and silanol-terminated or SiH-terminated dimethylpolysiloxane in the presence of a condensation-reaction catalyst; and (v) the platinum-catalyzed addition reaction between alpha,omega-dihydrogensiloxane oligomer and alpha, omega-dialkenylsiloxane oligomer, wherein the former precursor is exemplified by 1,1,3,3,5,5-hexamethyltrisiloxane, 1,1,3,3,5,5,7,7-octamethyltetrasiloxane, and so forth, and the latter precursor is exemplified by 1,1,3,3-tetramethyl-1,3-divinyldisiloxane, 1,1,3,3,5,5-hexamethyl-1,5-divinyltrisiloxane, 1,1,3,3,5,5,7,7-octamethyl-1,7-divinyltetrasiloxane, and so forth.

Another example of a synthetic method for component (B) consists of the hydrolysis of only organosilicon compound with the general formula

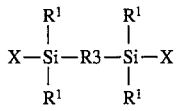

wherein $R^1$ and $R^3$ are defined as above and X is a halogen atom or hydrolyzable radical such as alkoxy or the like, or its cohydrolysis with diorganodihalosilane, and ensuing polycondensation in the presence of an endblocking agent.

For the purposes of the present invention, component (B) is added to the composition at from 0.01 to 500 weight parts per 100 weight parts component (A). The liquid composition according to the present invention is prepared by mixing the above-described components (A) and (B) to homogeneity. Suitable mixing methods are exemplified by the following: (i) mixing components (A) and (B) to homogeneity; (ii) blending component (B) into component (A) while stirring the latter; (iii) adding component (B) to a portion of component (A) with mixing to homogeneity and then admixing the remaining portion of component (A); and (iv) preparing a composition comprising components (A) and (B) and then stirring the composition while heating to 30° C. to 200° C. and preferably 50° C. to 150° C. The device used to prepare the composition according to the present invention is exemplified by drum rollers, homomixers, ball mills, colloid mills, and three-roll mills.

While the liquid composition according to the present invention comprises the above-described components (A) and (B), the composition may additionally contain, insofar as the object of the invention is not impaired, the various additives generally known for improving the properties of lubricating oils. These additives are exemplified by viscosity index improvers, antioxidants, detergent-dispersants, extreme-pressure additives, friction adjusters, oiliness improvers, rust inhibitors, colorants, defoaming agents composed of polydiorganosiloxane and silica micropowder or silicone resin, alcohols, water, surfactants, organic solvents, and so forth.

The liquid composition according to the present invention as described above is characterized by a low surface tension and excellent lubricating properties, which makes it useful for application in lubricants, release agents, cosmetics, and defoaming/foam-control agents. With regard to its lubricant applications, the liquid composition is useful for application as an automotive lubricating oil composition, such as, for example, as an automotive engine oil, e.g., gasoline-engine oil, diesel-engine oil, and so forth; as a gear oil, e.g., differential gear oil, transmission gear oil, and so forth; and as a chassis oil, e.g., power steering oil, automatic transmission oil, shock absorber oil, and so forth. The composition can also be employed as a refrigeration lubricant composition in air conditioners, heat pumps, refrigeration equipment that uses either Freon™ or a Freon™ substitute as refrigerant, and so forth. In addition, through exploitation of its low surface tension, the invention composition can be used for food additives, cosmetic raw materials, pharmaceutical raw materials, release agents, and so forth.

EXAMPLES

The liquid composition according to the present invention will be explained in greater detail below through working examples, in which "parts" indicates "weight parts" and the viscosity is the value measured at 25° C. The surface tension was measured by the pendant drop method using an automatic surface tension meter (model PD-Z Automatic Surface Tension Meter from Kyowa Kaimen Kagaku Kabushiki Kaisha).

Synthesis Example 1

Sym-tetramethyldisiloxane and 1,3-divinyltetramethyldisiloxane were polymerized by platinum-catalyzed hydrosilylation and the volatiles were thereafter removed from the reaction mixture by reduced-pressure distillation. The resulting reaction product was an organosilicon polymer with the following formula in which m is an integer with a value of at least 2.

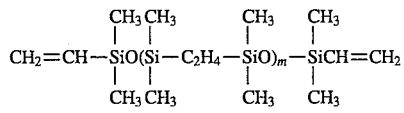

Its viscosity was 300 centipoise, and its density was 0.91.

Synthesis Example 2

Sym-tetramethyldisiloxane and 1,5-hexadiene were polymerized by platinum-catalyzed hydrosilylation and the volatiles were thereafter removed from the reaction mixture by reduced-pressure distillation. The resulting reaction product was an organosilicon polymer with the following formula in which m is an integer with a value of at least 2.

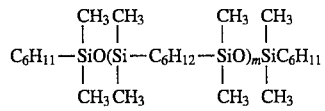

Its viscosity was 300 centipoise, and its density was 0.88.

Example 1

Liquid compositions were respectively prepared by mixing 1, 11, or 100 parts of the organosilicon polymer from Synthesis Example 1 in a flask, in each case with 100 parts of high-purity liquid paraffin (viscosity at 25° C.=163 centipoise, density at 25° C.=0.875, product of Kanto Kagaku Kabushiki Kaisha). The resulting liquid compositions, which were thick liquids at room temperature, were also transparent. Table 1 reports the surface tension results for these compositions. The surface tension of the high-purity liquid paraffin by itself was 30.6 mN/m.

TABLE 1

| amount of organosilicon polymer (parts) | surface tension (mN/m) |
|---|---|
| 1 | 25.0 |
| 11 | 25.0 |
| 100 | 24.9 |

Example 2

Liquid compositions were respectively prepared by mixing 11 or 100 parts of the organosilicon polymer from Synthesis Example 2 in a flask, in each case with 100 parts of a highly hydrogenatively refined oil (viscosity at 40° C.=30 centipoise, density at 15° C.=0.85, Purex 30 from Esso Sekiyu Kabushiki Kaisha). The resulting liquid compositions, which were thick liquids at room temperature, were also transparent. Table 2 reports the surface tension results for these compositions. The surface tension of the highly hydrogenatively refined oil by itself was 30.6 mN/m.

TABLE 2

| amount of organosilicon polymer (parts) | surface tension (mN/m) |
|---|---|
| 11 | 29.8 |
| 100 | 27.9 |

Comparative Example 1

A liquid composition was prepared as in Example 1, but in this case using trimethylsiloxy-endblocked dimethylpolysiloxane oil (viscosity at 25° C.=300 centipoise) in place of the organosilicon polymer from Synthesis Example 1 that was used in Example 1. In the case of this liquid composition, the liquid paraffin and dimethylpolysiloxane oil separated from each other over a period of 1 hour after the preparation of the composition.

Comparative Example 2

Another liquid composition was prepared as in Example 1, but in this case using trimethylsiloxy-endblocked dimethylsiloxane-methylphenylsiloxane copolymer (viscosity at 25° C.=300 centipoise, dimethylsiloxane unit:methylphenylsiloxane unit molar ratio=1:1) in place of the organosilicon polymer from Synthesis Example 1 that was used in Example 1. In the case of this liquid composition, the liquid paraffin and dimethylpolysiloxane oil separated from each other over a period of 24 hours after the preparation of the composition.

That which is claimed is:

1. A composition comprising:

(A) 100 parts by weight of a hydrocarbon oil that is liquid at ordinary temperature; and (B) 0.01 to 500 parts by weight of an organosilicon polymer that is liquid at ordinary temperatures, said polymer having the general formula

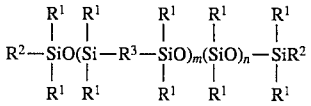

wherein $R^1$ denotes a non-alkenyl monovalent group selected from hydrocarbon radical and halogen-substituted hydrocarbon radical, $R^2$ is a radical selected from the group consisting of monovalent hydrocarbon radicals, hydrogen and hydroxyl, $R^3$ is an alkylene radical, m is an integer with a value of at least 2, n is an integer with a value of zero or greater and $m \geqq n$.

2. The composition according to claim 1, wherein $R^1$ is methyl.

3. The composition according to claim 1, wherein the viscosity of said hydrocarbon oil (A) and the viscosity of said organosilicon polymer (B) is each in the range 5 to 50,000 cS at 25° C.

4. The composition according to claim 1, wherein $R^1$ is independently selected from the group consisting of methyl, phenyl, 3,3,3-trifluoropropyl and 3,3,4,4,5,5,6,6,6-nonafluorohexyl.

5. The composition according to claim 4, wherein $R^2$ is selected from the group consisting of methyl, hydroxyl, hydrogen, vinyl, allyl and hexenyl.

6. The composition according to claim 1, wherein said hydrocarbon oil (A) is selected from the group consisting of paraffinic hydrocarbons and naphthenic hydrocarbons.

7. The composition according to claim 1, wherein said hydrocarbon oil (A) is selected from the group consisting of alkylbenzenes, alkyldiphenyls, poly(alpha-olefin) oils, and condensed synthetic oils from chloroparaffins and aromatic compounds.

8. The composition according to claim 6, wherein the viscosity of said hydrocarbon oil (A) and the viscosity of said organosilicon polymer (B) is each in the range 5 to 50,000 cS at 25° C.

9. The composition according to claim 8, wherein $R^1$ is independently selected from the group consisting of methyl, phenyl, 3,3,3-trifluoropropyl and 3,3,4,4,5,5,6,6,6-nonafluorohexyl.

10. The composition according to claim 9, wherein $R^2$ is selected from the group consisting of methyl, hydroxyl, hydrogen, vinyl, allyl and hexenyl.

11. The composition according to claim 7, wherein the viscosity of said hydrocarbon oil (A) and the viscosity of said organosilicon polymer (B) is each in the range 5 to 50,000 cS at 25° C.

12. The composition according to claim 11, wherein $R^1$ is independently selected from the group consisting of methyl, phenyl, 3,3,3-trifluoropropyl and 3,3,4,4,5,5,6,6,6-nonafluorohexyl.

13. The composition according to claim 12, wherein $R^2$ is selected from the group consisting of methyl, hydroxyl, hydrogen, vinyl, allyl and hexenyl.

14. The composition according to claim 1, wherein said organosilicon polymer (B) has a formula selected from the group consisting of

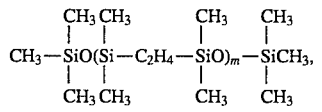

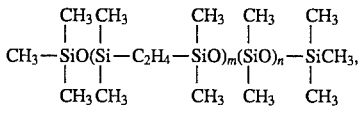

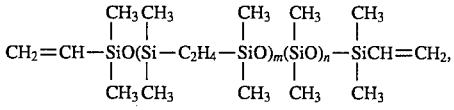

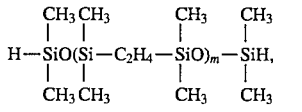

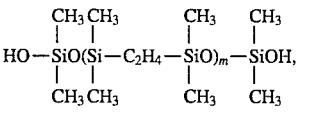

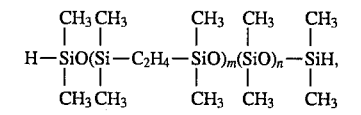

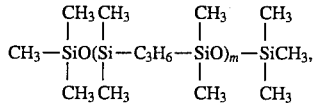

-continued $$H-SiO(Si-C_3H_6-SiO)_m-SiH,$$

$$CH_2=CH-SiO(Si-C_3H_6-SiO)_m-SiCH=CH_2,$$

$$HO-SiO(Si-C_3H_6-SiO)_m(SiO)_n-Si-OH,$$

$$CH_3-SiO(Si-C_6H_{12}-SiO)_m-SiCH_3,$$

$$CH_3-SiO(Si-C_6H_{12}-SiO)_m(SiO)_n-SiCH_3,$$

$$C_6H_{11}-SiO(Si-C_6H_{12}-SiO)_m(SiO)_n-SiC_6H_{11},$$

$$CH_3-SiO(Si-C_2H_4-SiO)_m(SiO)_n-SiCH_3,$$

$$CH_3-SiO(Si-C_2H_4-SiO)_m-SiCH_3,$$

-continued $$CH_3-SiO(Si-C_2H_4-SiO)_m(SiO)_n-SiCH_3,$$

$$CH_3-SiO(Si-C_2H_4-SiO)_m(SiO)_n-SiCH_3 \text{ and}$$

$$CH_3-SiO(Si-C_6H_{12}-SiO)_m(SiO)_n-SiCH_3$$

wherein m is an integer with a value of at least 2, n is an integer with a value of zero or greater and $m \geqq n$.

15. The composition according to claim 14, wherein said hydrocarbon oil (A) is selected from the group consisting of paraffinic hydrocarbons and naphthenic hydrocarbons.

16. The composition according to claim 14, wherein said hydrocarbon oil (A) is selected from the group consisting of alkylbenzenes, alkyldiphenyls, poly(alpha-olefin) oils, and condensed synthetic oils from chloroparaffins and aromatic compounds.

17. The composition according to claim 15, wherein the viscosity of said hydrocarbon oil (A) and the viscosity of said organosilicon polymer (B) is each in the range 10 to 10,000 cS at 25° C.

18. The composition according to claim 16, wherein the viscosity of said hydrocarbon oil (A) and the viscosity of said organosilicon polymer (B) is each in the range 10 to 10,000 cS at 25° C.

* * * * *